US010775728B2

(12) United States Patent
Fukumuro

(10) Patent No.: US 10,775,728 B2
(45) Date of Patent: Sep. 15, 2020

(54) IMAGE FORMING SYSTEM THAT PERFORMS COMMUNICATION CONTROL AND IMAGE FORMING APPARATUS

(71) Applicant: CANON KABUSHIKI KAISHA, Tokyo (JP)

(72) Inventor: Tadashi Fukumuro, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/557,134

(22) Filed: Aug. 30, 2019

(65) Prior Publication Data

US 2020/0081386 A1 Mar. 12, 2020

(30) Foreign Application Priority Data

Sep. 6, 2018 (JP) ..... 2018-167372

(51) Int. Cl.
*G03G 15/00* (2006.01)

(52) U.S. Cl.
CPC ..... *G03G 15/5075* (2013.01); *G03G 15/5004* (2013.01); *G03G 15/5012* (2013.01)

(58) Field of Classification Search
None
See application file for complete search history.

(56) References Cited

U.S. PATENT DOCUMENTS

2007/0223029 A1* 9/2007 Nonaka ..... G03G 15/5012 358/1.14
2013/0209132 A1* 8/2013 Soda ..... G03G 15/5004 399/75

FOREIGN PATENT DOCUMENTS

JP 2006133996 A 5/2006
JP 2006225108 A 8/2006
JP 2010036360 A 2/2010

* cited by examiner

*Primary Examiner* — Lennin R Rodriguezgonzalez
(74) *Attorney, Agent, or Firm* — Canon U.S.A., Inc. IP Division

(57) ABSTRACT

An image forming system in which a first control unit transmits, in a state there identification information is not set in an external apparatus, a confirmation command for confirming a state of the external apparatus to a second control unit before the first control unit transmits a registration command to the second control unit.

13 Claims, 8 Drawing Sheets

IMAGE FORMING SYSTEM THAT PERFORMS COMMUNICATION CONTROL AND IMAGE FORMING APPARATUS

BACKGROUND OF THE INVENTION

Field of the Invention

The present disclosure relates to an image forming apparatus for forming an image, such as a copying machine and a printer, and to an image forming system that performs control of communication with optional apparatuses attached to the image forming apparatus.

Description of the Related Art

In a conventional image forming apparatus, a plurality of attachable/detachable optional apparatuses is connected to the image forming apparatus main body. The image forming apparatus performs communication between the image forming apparatus main body (master) and the optional apparatuses (slaves) to achieve, for example, sheet feeding conveyance and sheet discharge conveyance in a cooperative manner.

For example, Japanese Patent Application Laid-Open No. 2006-133996 discusses a technique for performing communication between an image forming apparatus main body and a plurality of optional apparatuses connected to the main body in cascade. Specifically in the communication method, the image forming apparatus main body first registers unique identifier (ID) information to one optional apparatus connected to the image forming apparatus main body. Then, the one optional apparatus permits the image forming apparatus main body to make communication connection with another optional apparatus connected in cascade. The image forming apparatus main body repetitively registers unique II) information to each newly connected optional apparatus, and thus registers individual ID information to all of the optional apparatuses. When communicating with one specific optional apparatus, the image forming apparatus main body transmits a command signal as communication data including an ID information. If an optional apparatus has a corresponding ID information, out of the optional apparatuses that have received the command signal, the optional apparatus returns a status signal in response to the command signal.

The above-described image forming apparatus main body and optional apparatuses perform communication in the following procedures. When power of an optional apparatus is turned off (e.g., a sleep state of the image forming apparatus main body), the ID information registered in the optional apparatuses is cleared. Subsequently, when power of the optional apparatus is turned back to ON (e.g., return from the sleep state), the image forming apparatus main body registers the ID information for all of the optional apparatuses. Then, the image forming apparatus main body transmits a status information request command to all of the optional apparatuses to confirm the state of each optional apparatus. After the confirmation, the image forming apparatus main body performs power return processing. However, there has been an issue that separately performing each piece of processing described above prolongs total processing time, and thus resulting in downtime.

SUMMARY OF THE INVENTION

According to an aspect of the present disclosure, an image forming system includes an image forming apparatus, an external apparatus connectable to the image forming apparatus, and a communication unit configured to perform communication between the image forming apparatus and the external apparatus. The image forming apparatus includes a first control unit configured to communicate with the external apparatus by using the communication unit to transmit a registration command for setting identification information in the external apparatus. The external apparatus includes a second control unit configured to communicate with the image forming apparatus by using the communication unit to set the identification information therein based on the registration command. The first control unit transmits, in a state where the identification information is not set in the external apparatus, a confirmation command for confirming a state of the external apparatus to the second control unit before the first control unit transmits the registration command to the external apparatus.

Further features of the present disclosure will become apparent from the following description of exemplary embodiments with reference to the attached drawings.

DESCRIPTION OF THE EMBODIMENTS

Exemplary embodiments of the present disclosure will be described below with reference to the accompanying drawings. The following exemplary embodiments do not limit the present disclosure according to the appended claims. Not all of the combinations of the features described in the exemplary embodiments are indispensable to the solutions for the present disclosure.

[Image Forming Apparatus]

Figure 1:
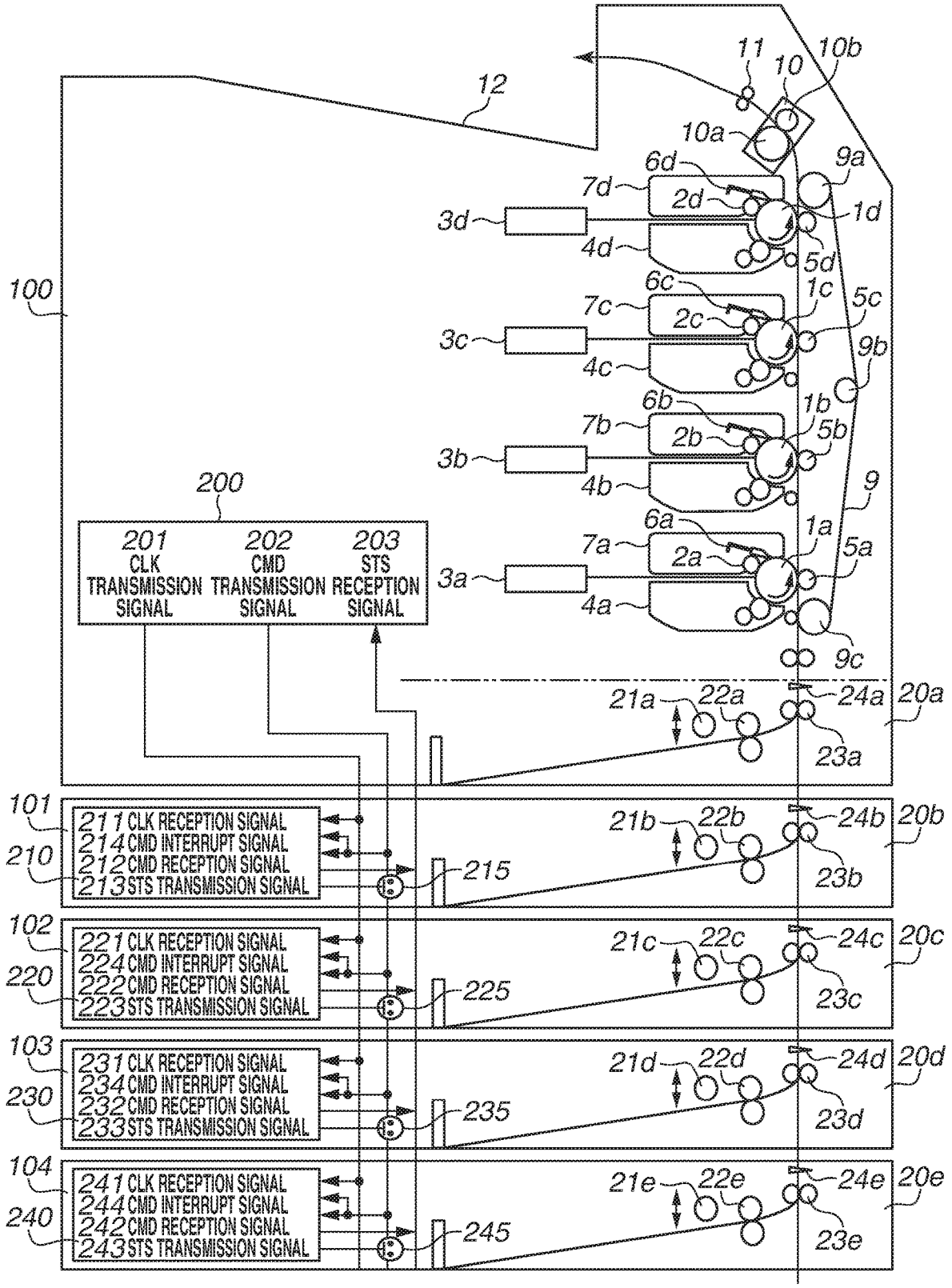
FIG. 1 is a schematic view illustrating a configuration of an image forming apparatus and optional apparatuses.

FIG. 1 is a schematic view illustrating a configuration of an image forming apparatus and optional apparatuses according to a first exemplary embodiment. FIG. 1 illustrates, as an example, an image forming apparatus main body 100, and a plurality of optional sheet feeding apparatuses 101, 102, 103, and 104 connectable with the image forming apparatus main body 100. The present exemplary embodiment will be described below centering on a direct transfer type color laser beam printer using a conveyance belt 9 as an example, the present disclosure is not limited thereto. As long as optional apparatuses can be attached and detached, the image forming apparatus may be an intermediate transfer type color laser beam printer, a monochrome laser beam printer, or an inkjet printer. Optional apparatuses can be external apparatuses connectable to the image forming apparatus main body 100. Further, the image forming apparatus and optional apparatuses are collectively referred to as an image forming system.

The image forming apparatus main body 100 forms a color image by overlapping images of four different colors (i.e., yellow (Y), magenta (M), cyan (C), and black (Bk)). Hereinafter, reference numerals of color-related components are supplied with additional characters a, b, c, and d corresponding to yellow, magenta, cyan, and black, respectively. If a color is not particularly specified, the additional characters may be omitted.

The image forming apparatus main body 100 includes photosensitive drums 1 as photosensitive members. A charging roller 2 as a charging unit, an exposure unit 3 including a light source as an exposure unit, and a development unit 4 including a developing roller as a development unit are disposed around each photosensitive drum 1. A transfer roller 5 as a transfer unit and a cleaning blade 6 as a cleaning unit are also disposed. These components can be collectively referred to as an image forming unit.

When the surface of a photosensitive drum 1 is uniformly charged by the charging roller 2, and the surface is exposed to light by the exposure unit 3, an electrostatic latent image is formed. Further, the development unit 4 applies toner to the electrostatic latent image formed on the photosensitive drum 1 to develop a toner image. The transfer roller 5 transfers the developed toner image onto a recording material. Residual toner remaining on the photosensitive drum 1 is removed by the cleaning blade 6.

Next, feeding operation of a recording material from a sheet feeding unit will be described. The sheet feeding unit in the image forming apparatus main body 100 will be described below as an example. Since the configuration of the sheet feeding unit in each optional apparatus has a similar configuration to the sheet feeding unit in the image forming apparatus main body 100, descriptions of the optional apparatuses will be omitted. A recording material stacked on the sheet feeding unit is fed to a feed roller 21*a*. The recording material is conveyed by conveyance rollers 22*a* and 23*a* and is detected by a registration sensor 24*a*. Further, the recording material is conveyed to the image forming unit by the conveyance belt 9 stretched around rollers 9*a*, 9*b* and 9*c*, and toner images of the respective colors are sequentially transferred onto the recording material. Accordingly, a multi-color image is formed on the recording material, and then, the recording material is heated and fixed by a fixing unit 10 including a pressure roller 10*a* as a pressure member and a heating film 10*b* as a heating member. Then, the recording material is discharged to a discharge tray 12 by a discharge roller 11.

[Communication Interfaces]

Next, communication interfaces as communication units between the image forming apparatus main body 100 and the optional sheet feeding apparatuses 101, 102, 103, and 104 illustrated in FIG. 1, will be described. The optional sheet feeding apparatuses 101, 102, 103, and 104 include optional control units 210, 220, 230, and 240 and switches 215, 225, 235, and 245, respectively. The main body control unit 200 of the image forming apparatus main body 100 is connected in cascade (series) connection with the optional control units 210, 220, 230, and 240 of the optional sheet feeding apparatuses 101, 102, 103, and 104.

Three kinds of signals are used for interface signals: a clock signal, a command signal, and a status signal. The clock signal (hereinafter referred to as a "CLK signal") is for taking synchronization in communication operation between the image forming apparatus and the optional sheet feeding apparatuses. The CLK signal is transmitted via a clock signal line. The command signal (hereinafter referred to as a "CLK signal") is for transmitting data from the image forming apparatus main body 100 to the optional sheet feeding apparatuses 101, 102, 103, and 104. The CMD signal is transmitted via a command signal line. The status signals (hereinafter referred to as "STS signals") is for transmitting data from the optional sheet feeding apparatuses 101, 102, 103, and 104 to the image forming apparatus main body 100. The STS signals are transmitted through a status signal line. The image forming apparatus main body 100 and the optional sheet feeding apparatuses 101, 102, 103, and 104 can communicate with each other by using the above-described signal lines.

In order to transmit and receive CLK signals, a CLK transmission signal 201 on the side of the main body control unit 200 is connected with CLK reception signals 211, 221, 231, and 241 on the side of the optional control units 210, 220, 230, and 240, respectively. In order to transmit and receive CMD signals, a CMD transmission signal 202 on the side of the main body control unit 200 is connected with CMD reception signals 212, 222, 232, and 242 on the side of the optional control units 210, 220, 230, and 240, respectively. In order to transmit and receive STS signals, an STS reception signal 203 on the side of the main body control unit 200 is connected with STS transmission signals 213, 223, 233, and 243 on the side of the optional control units 210, 220, 230, 240, respectively.

Further, in the optional sheet feeding apparatuses 101, 102, 103, and 104, the CMD reception signals 212, 222, 232, and 242 are branched and input to interrupt ports as command interrupt signals (hereinafter referred to as "CMD interrupt signals") 214, 224, 234, and 244. When each of the CMD interrupt signals is set to a Low level, an interrupt occurs. The switches 215, 225, 235, and 245 can change the connection state (e.g., connection or disconnection) of the CMD signals of the optional control units 210, 220, 230, and 240 in cascade connection. At a time of registering identification information (hereinafter referred to as ID information) to the optional sheet feeding apparatuses 101, 102, 103, and 104, all of the switches 215, 225, 235, and 245 are once disconnected. Then, the switches are sequentially connected from the one for the optional sheet feeding apparatus to which the ID information is to be registered, and each ID information is sequentially registered to the optional sheet feeding apparatuses 101, 102, 103, and 104.

Although, in this example, four different optional sheet feeding apparatuses are connected, the number of the optional apparatuses is not limited thereto, and any number of optional apparatuses are connectable. Further, in this example, optional sheet feeding apparatuses are used for target apparatuses. However, target apparatuses are not limited to the sheet feeding apparatus, and any optional apparatuses connectable to the image forming apparatus main body 100, for example, optional discharge apparatuses are also applicable.

[Descriptions of Control Block Diagram]

Figure 2:
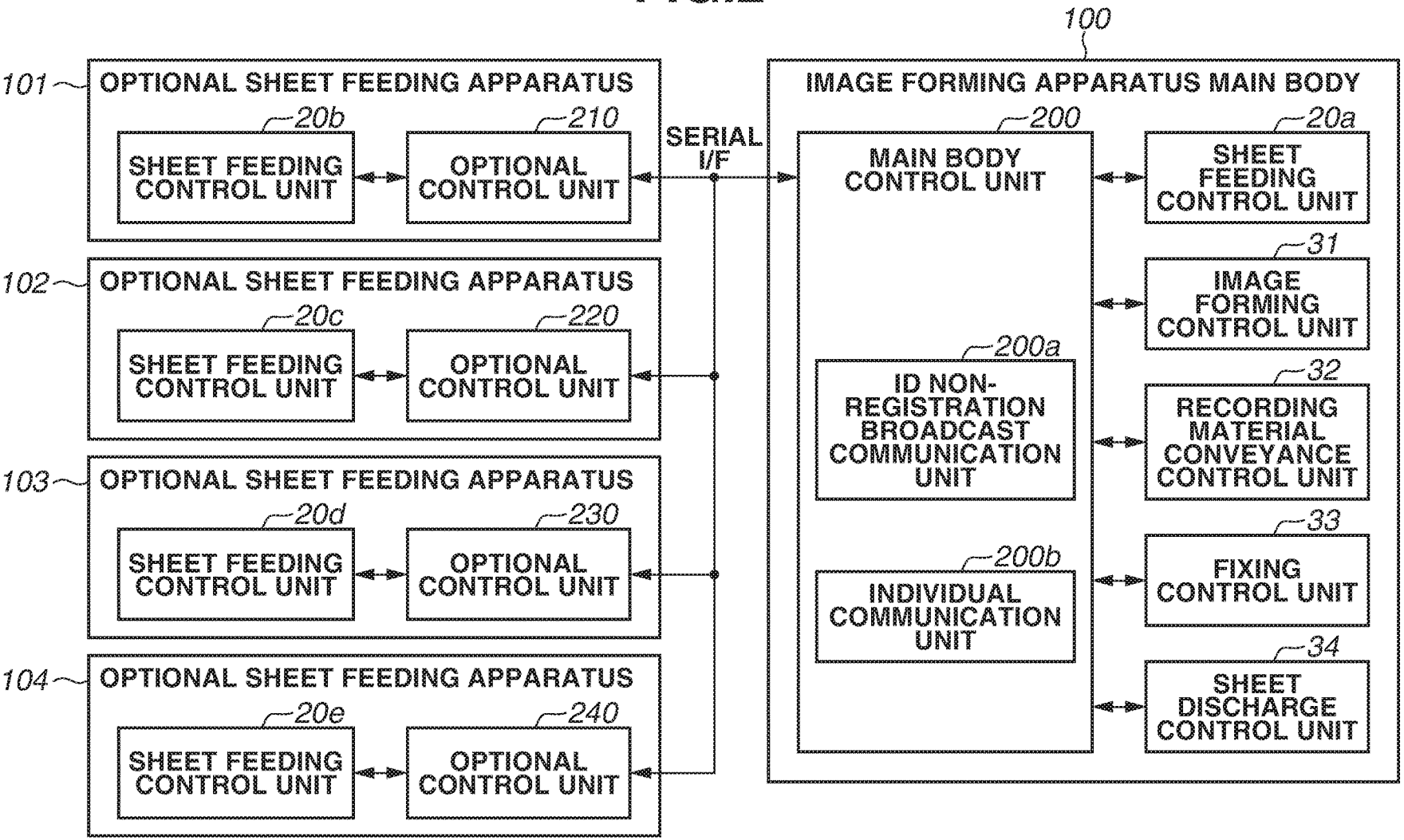
FIG. 2 is a control block diagram illustrating an image forming apparatus main body and optional sheet feeding apparatuses.

FIG. 2 is a control block diagram illustrating the image forming apparatus main body 100 and the optional sheet feeding apparatuses 101, 102, 103, and 104. The main body control unit 200 instructs the feed control unit 20*a* to feed a recording material, instructs the recording material conveyance control unit 32 to convey the recording material, and instructs the image forming control unit 31 to perform image forming to form an image on the conveyed recording material. The main body control unit 200 instructs the fixing control unit 33 to perform fixing control to fix a toner image formed onto the recording material and instructs the discharge control unit 34 to perform discharge control to discharge the recording material. The fixing control unit 33 performs separation control on the fixing nip portion, when the image forming apparatus main body 100 enters a sleep state, to prevent distortion of a fixing nip portion. The fixing control unit 33 then performs pressure control on the fixing nip portion when the image forming apparatus main body 100 returns from the sleep state.

The main body control unit 200 includes an ID non-registration broadcast communication unit 200*a* and an individual communication unit 200*b*. The ID non-registration broadcast communication unit 200*a* communicates with the optional sheet feeding apparatuses 101, 102, 103, and 104 on a broadcast basis when the ID information is not registered. The individual communication unit 200*b* communicates with an individual optional sheet feeding apparatus corresponding to added ID information after the ID information registration. The main body control unit 200 issues commands to the optional control units 210, 220, 230, and 240 via a serial interface (I/F).

The optional control units 210, 220, 230, and 240 instruct the sheet feeding control units 20*b*, 20*c*, 20*d*, and 20*e*, respectively, to feed a recording material. In order to prevent marks of feed rollers 21*b*, 21*c*, 21*d*, and 21*e* from remaining on the recording material, the sheet feeding control units 20*b*, 20*c*, 20*d*, and 20*e* perform separation control on the feed rollers when the image forming apparatus main body 100 enters the sleep state. When the image forming apparatus main body 100 returns from the sleep state, the sheet feeding control units 20*b*, 20*c*, 20*d*, and 20*e* performs contact control on the feed rollers.

[Communication Timing Chart: Individual Communication]

Figure 3:
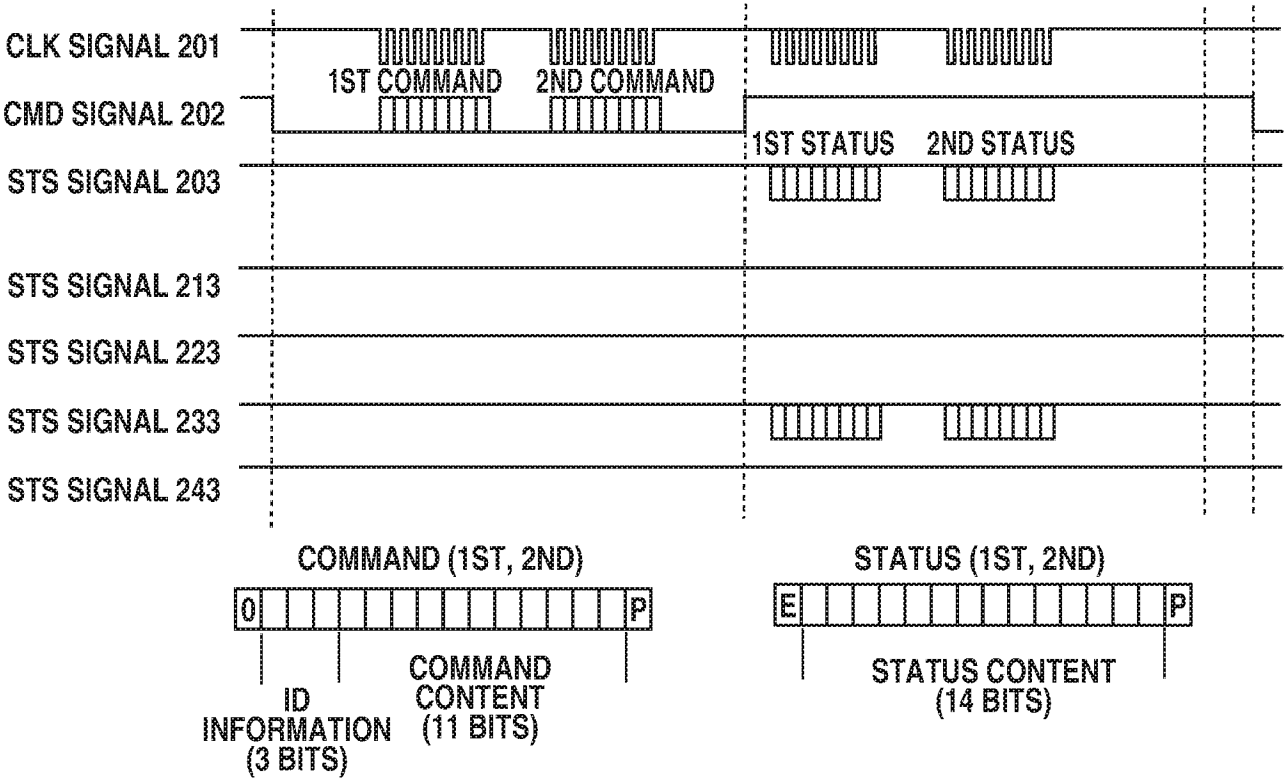
FIG. 3 is a timing chart illustrating communication operation between the image forming apparatus main body and the optional sheet feeding apparatuses.

FIG. 3 is a timing chart illustrating communication operation between the image forming apparatus main body 100 and the optional sheet feeding apparatuses 101, 102, 103, and 104. The timing chart illustrates individual communication in which, after registering unique ID information to each of the optional sheet feeding apparatuses 101, 102, 103, and 104, the image forming apparatus main body 100 performs communication by specifying the ID information.

According to the present exemplary embodiment, for command data and status data, one piece of data is formed by performing 8-bit data communication twice. The command data having 16-bit includes ID information, a command content, and a parity bit (P), as illustrated in FIG. 3. The status data having 16-bit includes an error bit (E) indicating the presence or absence of an error, a status content, and a parity bit (P), as illustrated in FIG. 3.

The optional sheet feeding apparatuses 101, 102, 103, and 104 enable interrupts by the CMD interrupt signals 214, 224, 234, and 244 before starting communication. According to the present exemplary embodiment, an interrupt can be accepted when each of the CMD interrupt signals 214, 224, 234, and 244 is set to the Low level. The main body control unit 200 of the image forming apparatus main body 100 sets the CMD transmission signal 202 to the Low level to start communication operation. When an interrupt occurs with the CMD interrupt signals, the optional sheet feeding apparatuses 101, 102, 103, and 104 determine the start of communication operation and prepares for command reception.

The main body control unit 200 transmits the command data on the CMD transmission signal 202 in synchronization with the CLK transmission signal 201. The optional sheet feeding apparatuses 101, 102, 103, and 104 analyze the received command to determine whether the ID information included in the command data coincides with the 1D information registered in the optional sheet feeding apparatuses. FIG. 3 illustrates an example of a command supplied with the II) information=3 that indicates a command for the optional sheet feeding apparatus 103. The optional sheet feeding apparatuses 101, 102, and 104 as non-target apparatuses determine that the ID information in the command is different from the ID information registered therein and prepare return status data FFh (all bits set to High). The sheet feeding apparatus 103 as a target apparatus determines that the ID information. In the command coincides with the ID information registered therein, analyzes the received command, and prepares return status data. Then, the sheet feeding apparatus 103 transmits the status data on the STS transmission signal 233 in synchronization with the CLK transmission signal 201 for status transmission.

The STS reception signal 203 is a low-True wired-OR connection signal. When all of the STS transmission signals 213, 223, 233, and 243 of the optional sheet feeding apparatuses 101, 102, 103, and 104, respectively, are set to High, the STS reception signal 203 is also set to High. As a result, the status data of the STS reception signal 203 coincides with the STS transmission signal 233 transmitted from the optional sheet feeding apparatus 103. The main body control unit 200 receives the STS reception signal 203.

[Communication Timing Chart: ID Non-Registration Broadcast Communication]

Figure 4A:
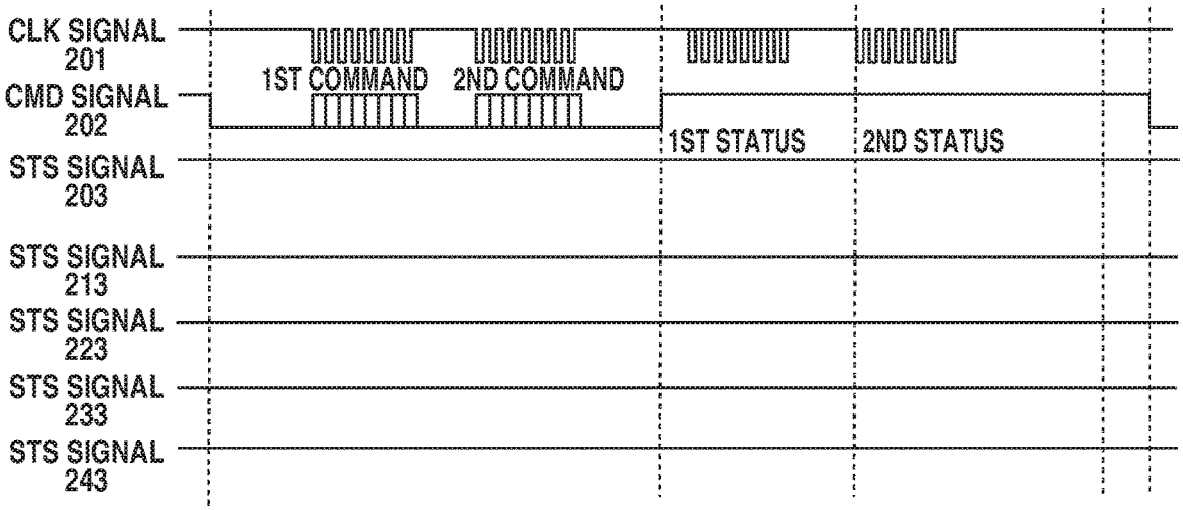
FIGS. 4A and 4B are timing charts illustrating communication operation between the image forming apparatus main body and the optional sheet feeding apparatuses.
Figure 4B:
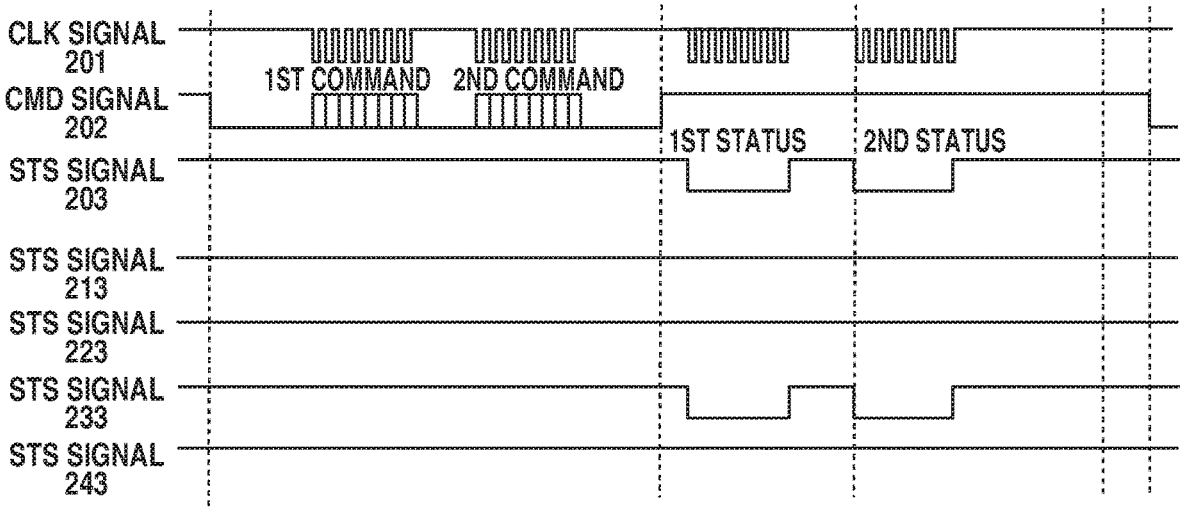

FIGS. 4A and 4B are timing charts illustrating communication operation between the image forming apparatus main body 100 and the optional sheet feeding apparatuses 101, 102, 103, and 104. FIGS. 4A and 4B illustrate ID non-registration broadcast communication in which the image forming apparatus main body 100 communicates with all of the optional sheet feeding apparatuses 101, 102, 103, and 104 on a broadcast basis before registering unique ID information to the optional sheet feeding apparatuses 101, 102, 103, and 104. The timing charts illustrated in FIGS. 4A and 4B indicate an example of a non-ready confirmation command. Specifically, the image forming apparatus main body 100 transmits a command supplied with the ID information=0, which indicates broadcasting, to all of the optional sheet feeding apparatuses, to determine whether any optional sheet feeding apparatus is not ready.

The main body control unit 200 transmits command data with the CMD transmission signal 202 in synchronization with the CLK transmission signal 201. The optional sheet feeding apparatuses 101, 102, 103, and 104 analyze the received command to determine whether the ID information included in the command data is the one registered therein or information indicating broadcasting. In this case, the ID information is data indicating broadcasting. The optional sheet feeding apparatuses 101, 102, 103, and 104 determine the data as a non-ready confirmation command for themselves. Then, the optional sheet feeding apparatuses 101, 102, 103, and 104 transmit a signal to indicate whether they are ready to the main body control unit 200.

FIG. 4A illustrates a case where all of the optional sheet feeding apparatuses 101, 102, 103, and 104 are ready. As an example, the optional sheet feeding apparatuses 101, 102, 103, and 104 determine whether they are ready, by detecting the open or closed state of the door by using a door sensor (not illustrated). If a door of one of the optional sheet feeding apparatuses 101, 102, 103, and 104 is open, the one of the optional sheet feeding apparatuses 101, 102, 103, and 104 determines that it is not ready. If the door is not open, the optional sheet feeding apparatuses 101, 102, 103, and 104 determine that they are ready. In this case, the optional sheet feeding apparatuses 101, 102, 103, and 104 determine that they are ready and prepare return status data FFh (all bits set to High). Since the status data received by the STS reception signal 203 is FFh (all bits set to High), the main body control unit 200 determines that all of the optional sheet feeding apparatuses 101, 102, 103, and 104 are ready.

FIG. 4B illustrates a case where the optional sheet feeding apparatuses 101, 102, and 104 are ready, and the optional sheet feeding apparatus 103 is not ready. The optional sheet feeding apparatuses 101, 102, and 104 detect the open or closed state of the door by using the door sensor (not illustrated). Since the door is not open, the optional sheet feeding apparatuses 101, 102, 103, and 104 determine that they are ready and prepare return status data FFh (all bits set to High). The optional sheet feeding apparatus 103 detects the open or closed state of the door by using a door sensor (not illustrated). Since the door is open, the optional sheet feeding apparatus 103 determines that the optional sheet feeding apparatus 103 itself is not ready and prepares return status data 00h (all bits set to Low). Since the status data received with the STS reception signal 203 is 00h (all bits set to Low), the main body control unit 200 determines any one optional apparatus is not ready. Specifically, although the main body control unit 200 cannot determine which optional sheet feeding apparatus is not ready, the main body control unit 200 can determine that at least one of the optional sheet feeding apparatuses 101, 102, 103, and 104 is not ready.

As illustrated in FIGS. 4A and 4B, the main body control unit 200 can determine whether all of the optional sheet feeding apparatuses 101, 102, 103, and 104 are ready by performing broadcast communication. After the main body control unit 200 determines that all of the optional sheet feeding apparatuses are ready, the main body control unit 200 can perform the following processing such as the ID registration. Although the main body control unit 200 determines whether the optional sheet feeding apparatuses 101, 102, 103, and 104 are ready based on the open state of the door, the main body control unit 200 may determine they are ready based on the open state of a sheet feed tray or other state. In other words, the determination criterion can be suitably set. At least, the main body control unit 200 can confirm whether all of the optional sheet feeding apparatuses 101, 102, 103, and 104 are ready through broadcast communication, even in a state where the ID information is not registered.

[Sleep Return Operation]

FIG. 5 is a timing chart illustrating a processing flow in which the main body control unit 200 of the image forming apparatus main body 100 controls a sleep return operation of the optional sheet feeding apparatuses 101, 102, 103, and 104. For example, when the image forming apparatus main body 100 enters the sleep state, the main body control 200 turns off power of the optional sheet feeding apparatuses 101, 102, 103, and 104 and sets the 1D information to be not registered. When the image forming apparatus main body 100 enters the sleep state, the main body control unit 200 also sets the fixing nip portion to be changed from the contact state to the separated state. The description is given of sleep return processing of the optional sheet feeding apparatuses 101, 102, 103, and 104, and the fixing nip portion changed from the separated state to the contact state, when the image forming apparatus main body 100 returns from the sleep state.

Figure 5A:
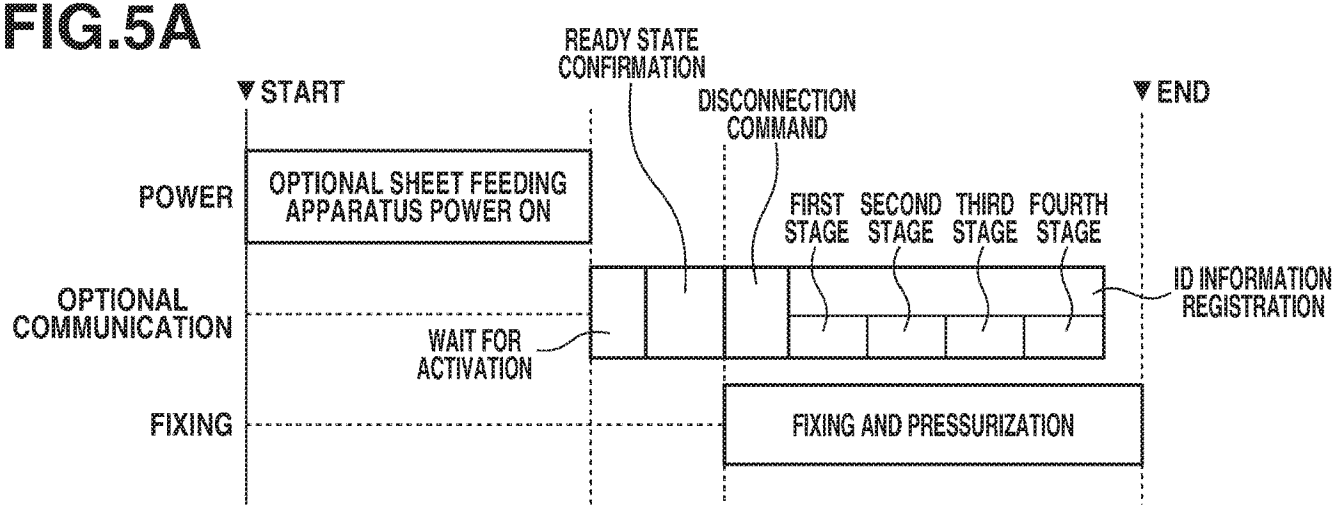
FIGS. 5A and 5B are timing charts illustrating a processing flow in which a main body control unit of the image forming apparatus main body controls a sleep return operation of the optional sheet feeding apparatuses.

FIG. 5A illustrates a method for confirming whether any one of the optional sheet feeding apparatuses 101, 102, 103, and 104 is not ready via the ID non-registration broadcast communication unit 200*a* before registering the ID information according to the present exemplary embodiment. When the main body control unit 200 determines to perform a sleep return, the main body control unit 200 turns on power of the optional sheet feeding apparatuses 101, 102, 103, and 104 and waits for the activation of the optional sheet feeding apparatuses. Then, the main body control unit 200 confirms whether all of the optional sheet feeding apparatuses 101, 102, 103, and 104 are ready through broadcast communication. When all of the optional sheet feeding apparatuses 101, 102, 103, and 104 are determined to be ready, the main body control unit 200 performs processing for registering unique ID information to each of the optional sheet feeding apparatuses. In parallel with the ID registration, the main body control unit 200 also performs processing for changing the fixing nip portion from the separated state to the contact state. Upon completion of the processing, the main body control unit 200 determines that the sleep return operation is completed. If the main body control unit 200 has received a print command, the main body control unit 200 starts printing.

Figure 5B:
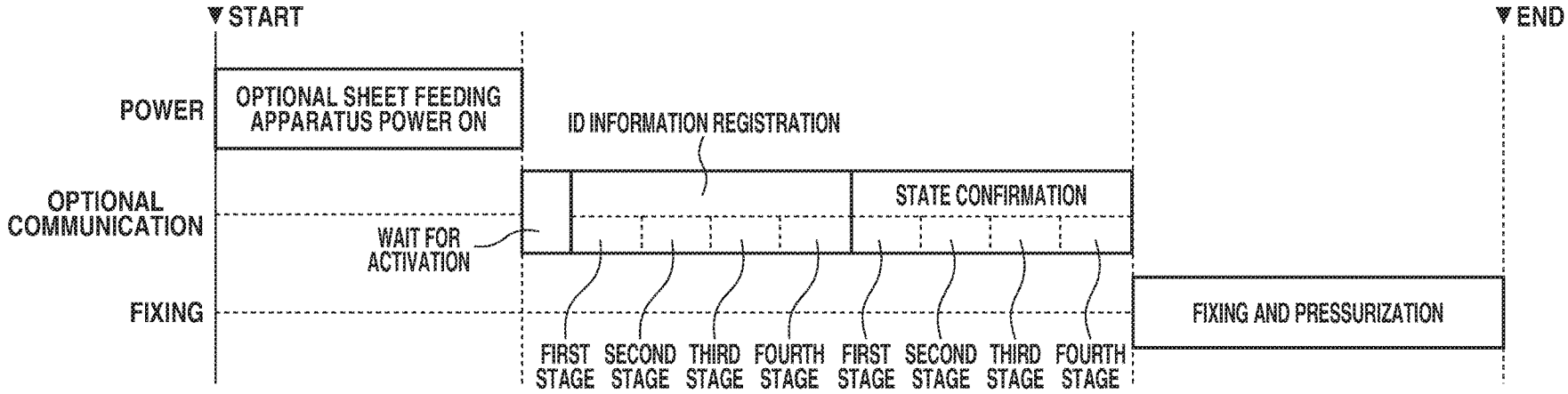

As a comparative example, FIG. 5B illustrates a method for confirming the ready state of each optional sheet feeding apparatus after registering unique ID information to the optional sheet feeding apparatuses 101, 102, 103, and 104. Referring to FIG. 5B, when the main body control unit 200 determines to perform a sleep return, the main body control unit 200 turns on power of the optional sheet feeding apparatuses 101, 102, 103, and 104 and waits for the activation of the optional sheet feeding apparatuses. Then, the main body control unit 200 registers unique ID information to all of the optional sheet feeding apparatuses 101, 102, 103, and 104 through serial communication. The main body control unit 200 also confirms whether all of the optional sheet feeding apparatuses are ready through serial communication. When all of the optional sheet feeding apparatuses are determined to be ready, the main body control unit 200 performs processing for changing the fixing nip portion from the separated state to the contact state. Upon completion of the processing of the fixing nip portion, the main body control unit 200 determines that the sleep return operation is completed. If the main body control unit 200 has received a print command, the main body control unit 200 starts printing.

According to the present exemplary embodiment, as described above, the main body control unit 200 can confirm at one time whether all of the optional sheet feeding apparatuses 101, 102, 103, and 104 are ready through broadcast communication. In other words, the main body control unit 200 can confirm the ready state of the optional sheet feeding apparatuses 101, 102, 103, and 104 through one-time communication. When all of the sheet feeding apparatuses 101, 102, 103, and 104 are determined to be ready, it becomes possible to perform in parallel processing for registering the ID information as a sleep return operation in the optional sheet feeding apparatuses and processing for changing the fixing nip portion to the contact state as a sleep return operation in the image forming apparatus main body 100. Accordingly, the use of control according to the present exemplary embodiment makes it possible to reduce the sleep return time in comparison with the comparative example.

Figure 6:
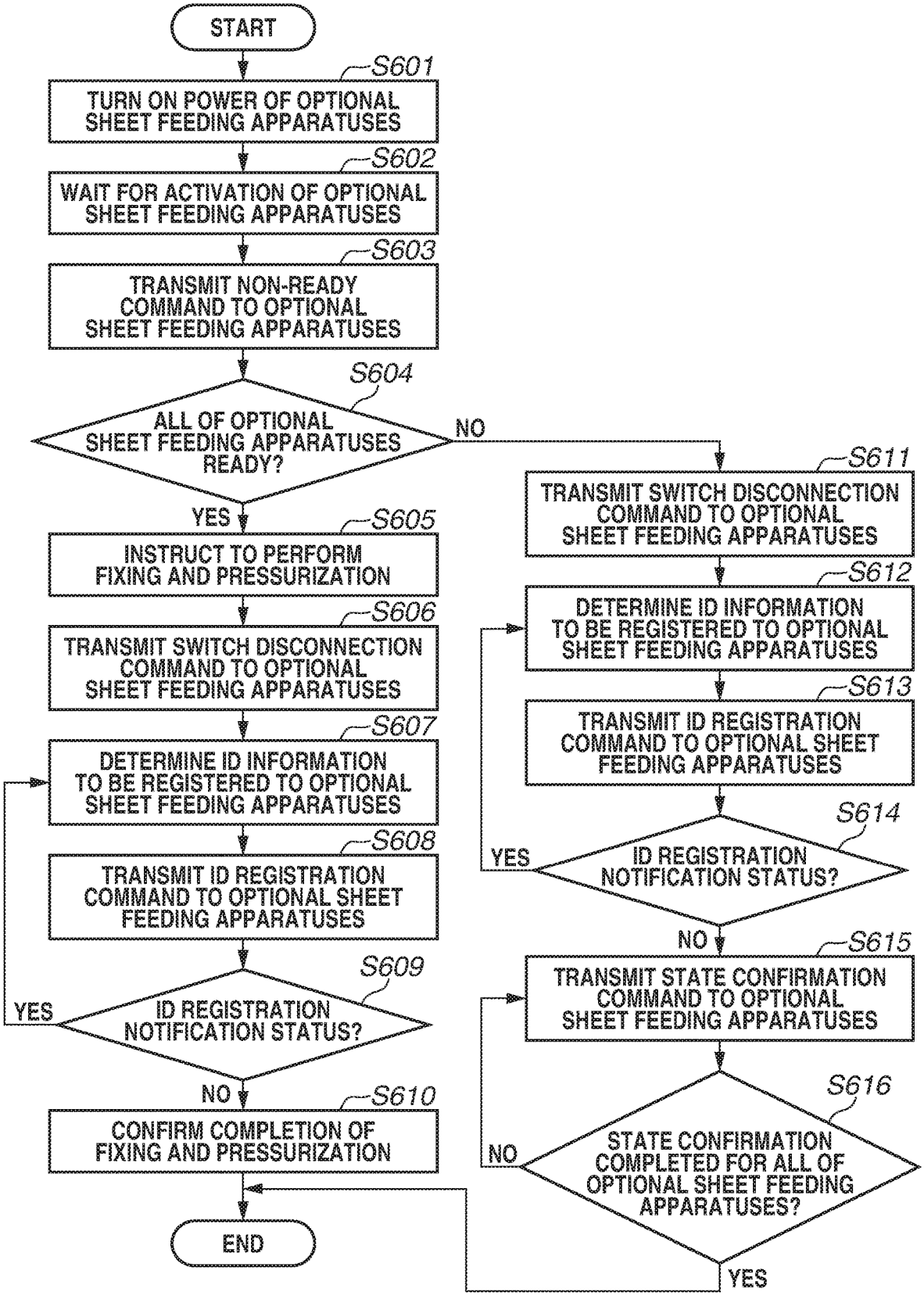
FIG. 6 is a flowchart illustrating a sleep return operation.

FIG. 6 is a flowchart illustrating the sleep return operation according to the present exemplary embodiment. In step S601, the main body control unit 200 turns on power of the optional sheet feeding apparatuses 101, 102, 103, and 104. In step S602, the main body control 200 waits for the activation of the optional sheet feeding apparatuses 101, 102, 103, and 104. When the optional sheet feeding apparatuses 101, 102, 103, and 104 are activated, the ID information is not registered and the switches 215, 225, 235, and 245 are in connection state.

In step S603, the main body control unit 200 collectively transmits a non-ready command to all of the optional sheet feeding apparatuses 101, 102, 103, and 104 through broadcast communication via the ID non-registration broadcast communication unit 200*a*. In step S604, the main body control unit 200 receives the STS transmission signals from the optional sheet feeding apparatuses 101, 102, 103, and 104 to check whether any optional sheet feeding apparatus is not ready.

When the main body control unit 200 determines that all of the optional sheet feeding apparatuses are ready (YES in step S604), the processing proceeds to step S605. In step S605, the main body control unit 200 issues a fixing and pressurization command to change the fixing nip portion to the contact state as a sleep return operation in the image forming apparatus main body 100. In step S606, the main body control unit 200 performs the sleep return operation in the optional sheet feeding apparatuses 101, 102, 103, and 104 in parallel with the sleep return operation in the image forming apparatus main body 100. The main body control unit 200 transmits a switch disconnection command to each optional sheet feeding apparatus via the ID non-registration broadcast communication unit 200*a*. Upon reception of the switch disconnection command, each optional sheet feeding apparatus disconnects a switch.

In step S607, the main body control unit 200 determines the ID information to be registered to each optional sheet feeding apparatus. Specifically, the main body control unit 200 uniquely determines the ID information by setting the ID information to 1, 2, and 3 in this order. In step S608, the main body control unit 200 transmits an ID registration command supplied with the ID information to be registered to the optional sheet feeding apparatuses 101, 102, 103, and 104. In this case, the main body control unit 200 first transmits an ID registration command supplied with the ID information=1. Upon reception of the ID registration command, each optional sheet feeding apparatus registers the ID information, changes the switch to the connection state, and transmits an ID registration notification status (meaning the completion of the ID registration) to the main body control unit 200.

In step S609, the main body control unit 200 determines Whether the received status is an ID registration notification status. When the received status is an ID registration notification status (YES in step S609), another optional sheet feeding apparatus may still be connected, and thus the processing returns to step S607. In step S607, the main body control unit 200 determines the ID information=2. The main body control unit 200 transmits an ID registration command supplied with the ID information=2 again to the optional sheet feeding apparatuses 101, 102, 103, and 104. The main body control unit 200 repeats this sequence so that the ID information=1, 2, 3, and 4 is registered to the optional sheet feeding apparatuses 101, 102, 103, and 104, respectively. The ID registration notification status is not returned in response to the ID registration command with the ID information=5. Thus, the main body control unit 200 determines that the ID registration has been completed for all of the optional sheet feeding apparatuses 101, 102, 103, and 104, and that the ID registration has ended with the ID information=4. On the other hand, when the ID registration notification status is not returned (NO in step S609), the main body control unit 200 determines that the ID registration is completed, and the processing proceeds to step S610. In step S610, the main body control unit 200 confirms whether fixing and pressurization operations are completed. When these operations are completed, the main body control unit 200 determines that the sleep return operation is completed.

On the other hand, when the main body control unit 200 determines that any one optional sheet feeding apparatus is not ready (NO in step S604), the processing proceeds to step S611. In step S611, the main body control unit 200 does not issue a fixing and pressurization command as a sleep return operation by the image forming apparatus main body 100, and suspends the command issuance. The main body control unit 200 then registers the ID information to each optional sheet feeding apparatus. Processing in steps S611 to S614 is similar to the processing in steps S606 to S609, and thus redundant descriptions thereof will be omitted.

In step S615, the main body control unit 200 transmits a state confirmation command to each optional sheet feeding apparatus by using the registered ID information and then determines which optional sheet feeding apparatus is not ready. In step S616, the main body control unit 200 determines whether the ready state confirmation is completed for all of the optional sheet feeding apparatuses 101, 102, 103, and 104. When the ready state confirmation is completed for all of the optional sheet feeding apparatuses 101, 102, 103, and 104 (YES in step S616), the processing ends. Although the main body control unit 200 ends the processing when the ready state confirmation is completed, as an example, the present disclosure is not limited thereto. When the main body control unit 200 confirms that all of the optional sheet feeding apparatuses 101, 102, 103, and 104 have become ready, the main body control unit 200 may issue the suspended fixing and pressurization command.

As described above, the main body control unit 200 confirms at one time whether all of the optional sheet feeding apparatuses 101, 102, 103, and 104 are ready through broadcast communication. In other words, the main body control unit 200 confirms the ready state of the optional sheet feeding apparatuses 101, 102, 103, and 104 through one-time communication. When all of the sheet feeding apparatuses 101, 102, 103, and 104 are determined to be ready, it becomes possible to perform in parallel processing for registering the ID information as a sleep return operation in the optional sheet feeding apparatuses and processing for changing the fixing nip portion to the contact state as a sleep return operation in the image forming apparatus main body 100. Accordingly, the time of the sleep return operation can be reduced.

Although, in the present exemplary embodiment, power is turned off when the optional sheet feeding apparatuses enter the sleep state as an example, the present disclosure is not limited thereto. The present exemplary embodiment is applicable to a case where broadcast communication is performed before registering the ID information of the optional sheet feeding apparatuses, for example, when power of the image forming apparatus is turned off not when the sleep state is entered. For either case, processing time can be reduced, in a state where the ID information is not registered, by first performing the state confirmation on the optional sheet feeding apparatuses and then, after the state confirmation, performing in parallel the ID information registration and other return processing.

Although the present exemplary embodiment has been described above centering on an example case where four different optional sheet feeding apparatuses are connected, the present disclosure is not limited thereto. One or a plurality of optional sheet feeding apparatuses can be connected. Regardless of the number of optional sheet feeding apparatuses, processing time can be reduced, in a state where the ID information is not registered, by first performing the state confirmation on the optional sheet feeding apparatuses and then, after the state confirmation, performing in parallel the ID information registration and other return processing. In consideration of serial communication with a plurality of optional apparatuses as in conventional cases, processing time can be decreased with increasing number of optional apparatuses to be connected. In addition to sheet feeding apparatuses, similar control is also applicable to other optional apparatuses, such as a sheet discharge apparatus, as long as the optional apparatus is capable of communicating with the image forming apparatus main body 100.

According to the first exemplary embodiment, controlling the contact states of the nip portion is used as a sleep return operation in the image forming apparatus main body 100. According to a second exemplary embodiment, controlling contact states of the feed rollers is used as a sleep return operation. For configurations similar to the ones according to the first exemplary embodiment, such as the configuration of the image forming apparatus, detailed descriptions thereof will be omitted.

[Sleep Return Operation]

FIG. 7 is a timing chart illustrating a processing flow in which the main body control unit 200 of the image forming apparatus main body 100 controls the sleep return operation of the optional sheet feeding apparatuses 101, 102, 103, and 104. For example, when entering the sleep state, the main body control unit 200 turns off power of the optional sheet feeding apparatuses 101, 102, 103, and 104 and sets the ID information to be not registered. When entering the sleep state, the main body control unit 200 sets the feed rollers 21*b*, 21*c*, 21*d*, and 21*e* of the optional sheet feeding apparatuses 101, 102, 103, and 104, respectively, to be changed to the separated state. The following describes a case where contact processing of the feed rollers 21*b*, 21*c*, 21*d*, and 21*e* is performed in parallel with the ID information registration to the optional sheet feeding apparatuses 101, 102, 103, and 104, when returning from the sleep state.

Figure 7A:
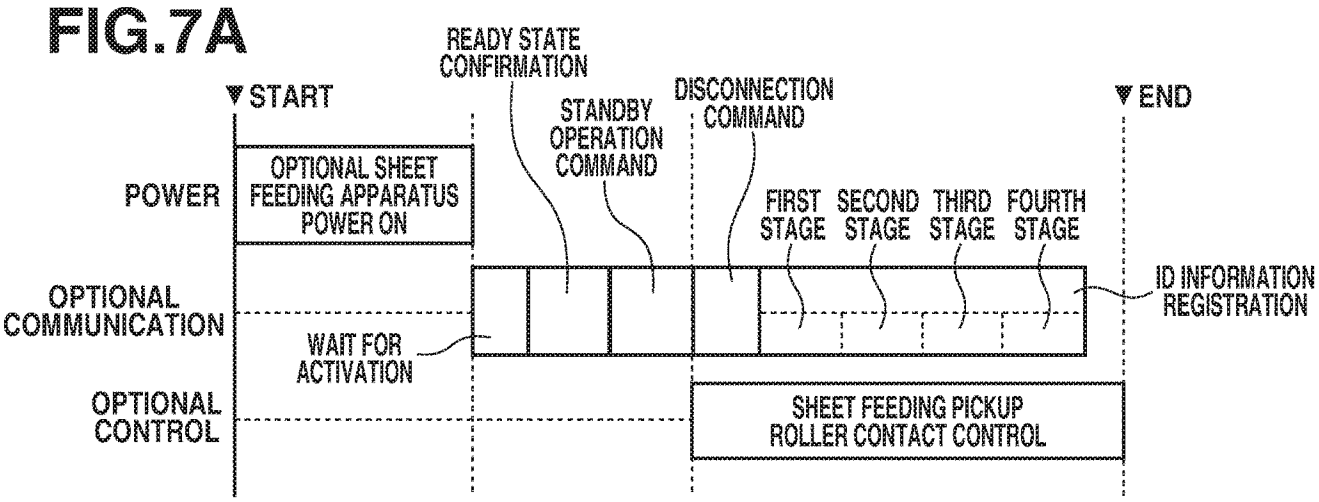
FIGS. 7A and 7B are timing charts illustrating another processing flow in which the main body control unit of the image forming apparatus main body controls the sleep return operation of the optional sheet feeding apparatuses.

FIG. 7A illustrates a method for confirming whether any one of the optional sheet feeding apparatuses 101, 102, 103, and 104 is not ready via the ID non-registration broadcast communication unit 200*a* before registering the ID information according to the present exemplary embodiment. When the main body control unit 200 determines to perform a sleep return, the main body control unit 200 turns on power of the optional sheet feeding apparatuses 101, 102, 103, and 104 and waits for the activation of the optional sheet feeding apparatuses. Then, the main body control unit 200 confirms whether all of the optional sheet feeding apparatuses 101, 102, 103, and 104 are ready through broadcast communication. When all of the optional sheet feeding apparatuses are determined to be ready, the main body control unit 200 performs processing for registering unique ID information to each of the optional sheet feeding apparatuses 101, 102, 103, and 104. Further, the main body control unit 200 performs processing for changing the teed rollers 21*b*, 21*c*, 21*d*, and 21*e* from the separated state to the contact state. Upon completion of the processing, the main body control unit 200 determines that the sleep return operation is completed. If the main body control unit 200 has received a print command, the main body control unit 200 starts printing.

Figure 7B:
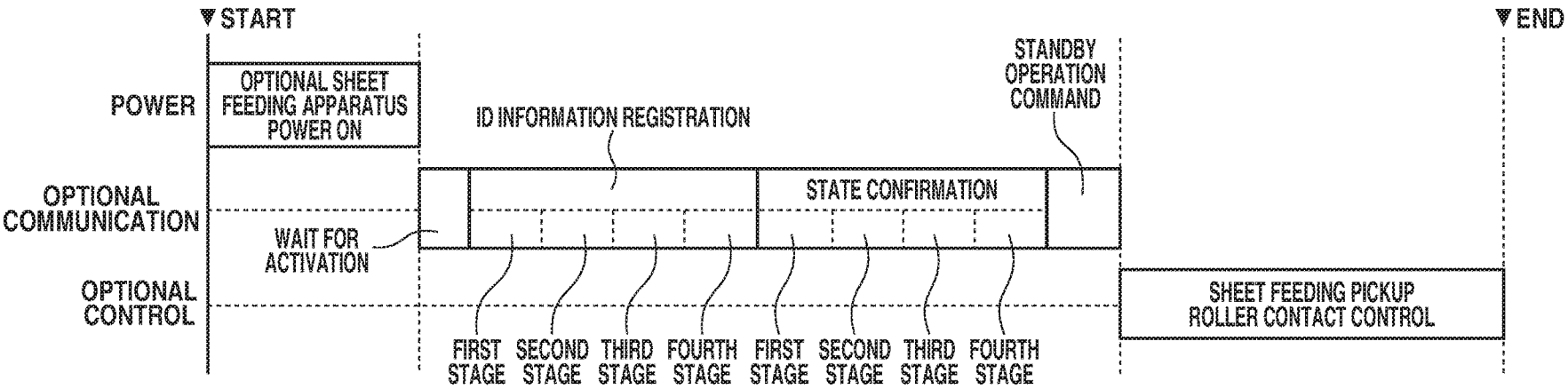

As a comparative example, FIG. 7B illustrates a method for confirming the ready state of each optional sheet feeding apparatus after registering unique ID information to the optional sheet feeding apparatuses 101, 102, 103, and 104. Referring to FIG. 7B, when the main body control unit 200 determines to perform a sleep return, the main body control unit 200 turns on power of the optional sheet feeding apparatuses 101, 102, 103, and 104 and waits for the activation of the optional sheet feeding apparatuses. Then, the main body control unit 200 registers unique ID information to all of the optional sheet feeding apparatuses through serial communication. Then, the main body control unit 200 also confirms whether all of the optional sheet feeding apparatuses are ready through serial communication. When all of the optional sheet feeding apparatuses are determined to be ready, the main body control unit 200 performs processing for changing the feed rollers from the separated state to the contact state. Upon completion of the processing of the feed rollers, the main body control unit 200 determines that the sleep return operation is completed. If the main body control unit 200 has received a print command, the main body control unit 200 starts printing.

According to the present exemplary embodiment, as described above, the main body control unit 200 can confirm at one time whether all of the optional sheet feeding apparatuses are ready through broadcast communication. In other words, the main body control unit 200 can confirm the ready state of the optional sheet feeding apparatuses 101, 102, 103, and 104 through one-time communication. When all of the sheet feeding apparatuses are determined to be ready, it becomes possible to perform in parallel processing for registering the ID information and processing for changing the feed rollers to the contact state as sleep return operations in the optional sheet feeding apparatuses. Accordingly, the use of control according to the present exemplary embodiment makes it possible to reduce the sleep return tithe in comparison with the comparative example.

Figure 8:
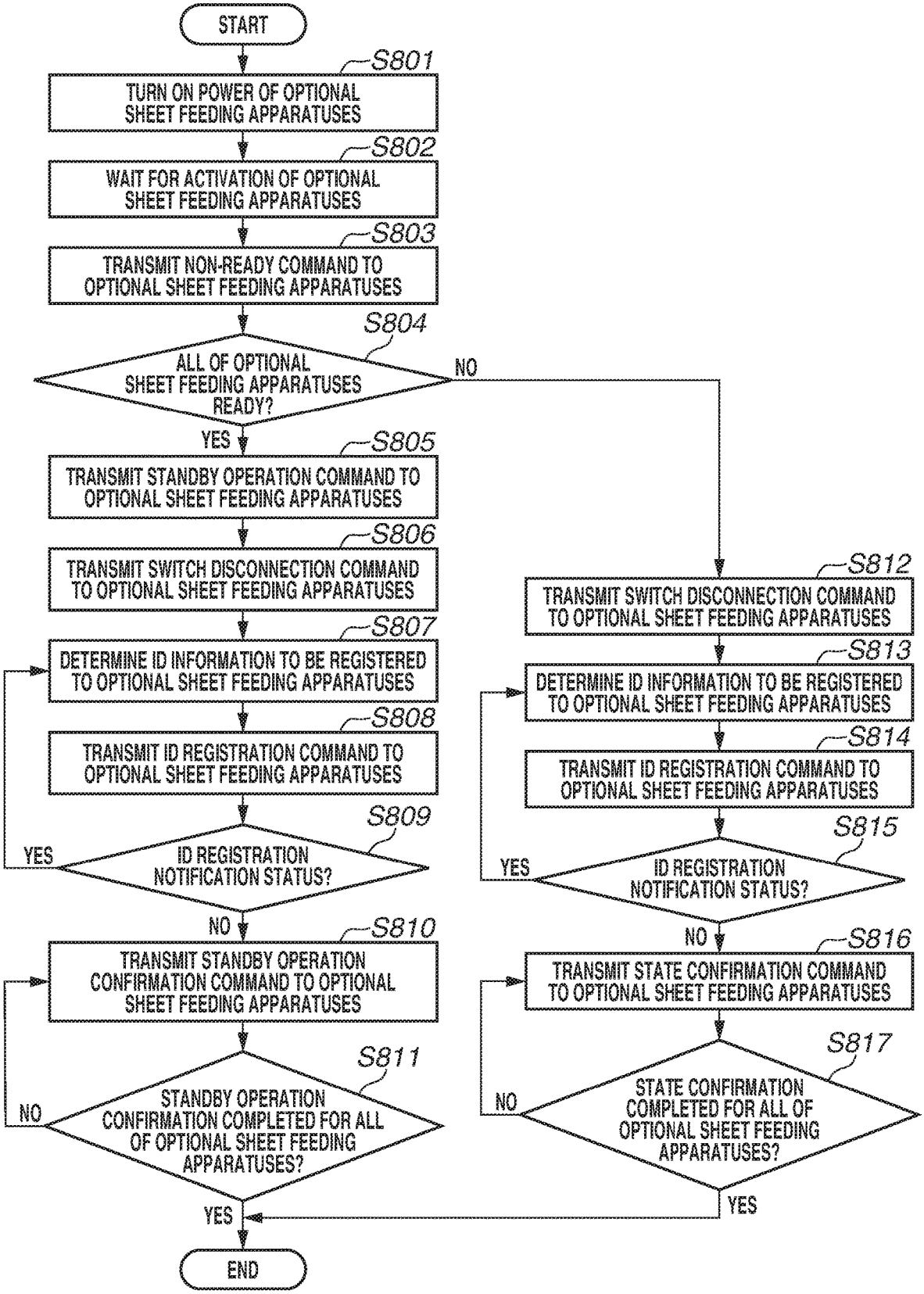
FIG. 8 is another flowchart illustrating the sleep return operation.

FIG. 8 is a flowchart illustrating the sleep return operation according to the present exemplary embodiment. Processing in steps S801 to S804 is similar to the processing in steps S601 to S604 illustrated in FIG. 6 according to the first previous exemplary embodiment, and detailed descriptions thereof will be omitted.

When the main body control unit 200 determines that all of the optional sheet feeding apparatuses are ready (YES in step S804), the processing proceeds to step S805. In step S805, the main body control unit 200 issues a standby operation command to the optional sheet feeding apparatuses 101, 102, 103, and 104 via the ID non-registration broadcast communication unit 200*a*. Upon reception of the standby operation command, the optional sheet feeding apparatuses 101, 102, 103, and 104 perform control to change the feed rollers from the separated state to the contact state as a standby operation when returning from the sleep state. In step S806, in parallel with the processing for changing the feed rollers from the separated state to the contact state, the main body control unit 200 transmits a switch disconnection command to the optional sheet feeding apparatuses 101, 102, 103, and 104 via the ID non-registration broadcast communication unit 200*a*. Upon reception of the switch disconnection command, each optional sheet feeding apparatus disconnects the switch.

In step S807, the main body control unit 200 determines the ID information to be registered to each optional sheet feeding apparatus. Specifically, the main body control unit 200 uniquely determines the ID information by setting the ID information to 1, 2, and 3 in this order. In step S808, the main body control unit 200 transmits an ID registration command supplied with the ID information to be registered to the optional sheet feeding apparatuses 101, 102, 103, and 104. In this case, the main body control unit 200 first transmits an ID registration command supplied with the ID information=1. Upon reception of the ID registration command, each optional sheet feeding apparatus registers the ID information, changes the switch to the connection state, and transmits an ID registration notification status (meaning the completion of the registration) to the main body control unit 200.

In step S809, the main body control unit 200 determines whether the received status is an ID registration notification status. When the received status is an ID registration notification status (YES in step S809), another optional sheet feeding apparatus may still be connected, and thus the processing returns to step S807. In step S807, the main body control unit 200 determines the ID information=2. The main body control unit 200 transmits an ID registration command supplied with the ID information=2 again to the optional sheet feeding apparatuses 101, 102, 103, and 104. The main body control unit 200 repeats this sequence so that the ID information=1, 2, 3, and 4 is registered to the optional sheet feeding apparatuses 101, 102, 103, and 104, respectively. The ID registration notification status is not returned in response to the ID registration command with the ID information=5. Thus, the main body control unit 200 determines that the ID registration has been completed for all of the optional sheet feeding apparatuses 101, 102, 103, and 104, and that the ID registration has ended with the ID information=4. When the ID registration notification status is not returned (NO in step S809), the main body control unit 200 determines that the ID registration is completed, and the processing proceeds to step S810. In step S810, the main body control unit 200 transmits a standby operation confirmation command to the optional sheet feeding apparatuses 101, 102, 103, and 104. In step S811, in response to the standby operation confirmation command, the main body control unit 200 confirms whether contact control for the feed rollers is completed in each optional sheet feeding apparatus. When the contact control is completed, the main body control unit 200 determines that the sleep return operation is completed (YES in step S811).

On the other hand, when the main body control unit 200 determines that any one optional sheet feeding apparatus is not ready (NO in step S804), the processing proceeds to step S812. In step S812, the main body control unit 200 does not issue a standby operation command to the optional sheet feeding apparatuses 101, 102, 103, and 104, and suspends the command issuance. Further, the main body control unit 200 registers the ID information to each optional sheet feeding apparatus. Processing in steps S812 to S815 is similar to that in steps S806 to S809, and descriptions thereof will be omitted.

In step S816, the main body control unit 200 transmits a state confirmation command to each optional sheet feeding apparatus by using the registered ID information and then determines which optional sheet feeding apparatus is not ready. In step S817, the main body control unit 200 determines whether the ready state confirmation is completed for all of the optional sheet feeding apparatuses. When the ready state confirmation is completed for all of the optional sheet feeding apparatuses (YES in step S817), the processing ends. Although the main body control unit 200 ends the processing when the ready state confirmation is completed, the present disclosure is not limited thereto. When the main body control unit 200 confirms that all of the optional sheet feeding apparatuses have become ready, the main body control unit 200 may perform the suspended feed roller contact control.

As described above, the main body control unit 200 can confirm at one time whether all of the optional sheet feeding apparatuses are ready through broadcast communication. In other words, the main body control unit 200 confirms the ready state of the optional sheet feeding apparatuses 101, 102, 103, and 104 through one-time communication. When all of the sheet feeding apparatuses are determined to be ready, it is possible to perform in parallel processing for registering the ID information and processing for changing the feed rollers to the contact state as sleep return operations in the optional sheet feeding apparatuses 101, 102, 103, and 104. This enables reducing the time of the sleep return operation. Although, in the present exemplary embodiment, feed roller contact control is performed as an example of a standby operation of the optional sheet feeding apparatuses, the present disclosure is not limited thereto. For example, control for elevating the sheet feed tray is also applicable. It is also possible to perform in parallel the standby operation of the optional sheet feeding apparatuses and the standby operation of the image forming apparatus main body 100 according to the first exemplary embodiment.

The present disclosure makes it possible to reduce downtime.

While the present invention has been described with reference to exemplary embodiments. It is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-167372, filed Sep. 6, 2018, which is hereby incorporated by reference herein in its entirety.

What is claimed is:

1. An image forming system comprising:

an image forming apparatus;

an external apparatus connectable to the image forming apparatus; and a communication unit configured to perform communication between the image forming apparatus and the external apparatus, wherein the image forming apparatus includes a first control unit configured to communicate with the external apparatus by using the communication unit to transit a registration command for setting identification information to the external apparatus, wherein the external apparatus includes a second control unit configured to communicate with the image forming apparatus by using the communication unit to set the identification information therein based on the registration command, and wherein the first control unit transmits, in a state where the identification information is not set in the external apparatus, a confirmation command for confirming a state of the external apparatus to the second control unit before the first control unit transmits the registration command to the external apparatus.

2. The image forming system according to claim 1, wherein the second control unit returns, upon reception of the confirmation command, a status to the first control unit according to the state of the external apparatus.

3. The image forming system according to claim 2, wherein the first control unit transmits the registration command to the second control unit after receiving the status from the second control unit.

4. The image forming system according to claim 1, wherein the image forming apparatus further includes an image forming unit configured to form an image on a recording material, and a fixing unit configured to perform fixing processing on the recording material with an image formed thereon, by using a heating member and a pressure member, and wherein the first control unit changes, in parallel with registration of the identification information based on the registration command, a state of the heating and pressure members in the fixing unit from a separated state to a contact state.

5. The image forming system according to claim 1, wherein the external apparatus further includes a stacking unit configured to stack recording materials, and a sheet feeding unit configured to feed the recording materials stacked on the stacking unit, and wherein the second control unit changes, in parallel with registration of the identification information based on the registration command, a state of the sheet feeding unit and a recording material from a separated state to a contact state.

6. The image forming system according to claim 1, wherein the communication unit includes a clock signal line configured to transmit a clock signal from the image forming apparatus to the external apparatus, a command signal line configured to transmit a command signal from the image forming apparatus to the external apparatus in synchronization with the clock signal, and a status signal line configured to transmit a status signal from the external apparatus to the image forming apparatus in synchronization with the clock signal.

7. The image forming system according to claim 1, wherein the image forming apparatus is connectable with a plurality of e external apparatuses, and wherein each of the plurality of the external apparatuses includes a switching unit configured to switch a connection state of communication with other external apparatuses.

8. The image forming system according to claim 7, wherein each of the plurality of the external apparatuses changes, in a state where the identification information is not set, a state of the switching unit to a connection state, and wherein the first control unit transmits at one time a confirmation command for confirming the states of the external apparatuses to the plurality of the external apparatuses.

9. The image forming system according to claim 8, wherein the plurality of the external apparatuses changes, upon reception of the confirmation command, the state of the switching unit to a disconnection state, wherein the first control unit transmits the registration command to a first external apparatus out of the plurality of the external apparatuses, wherein the first external apparatus registers identification information when identification information is not registered in the first external apparatus, and wherein the first external apparatus transmits the registration command to a second external apparatus when identification information is registered in the first external apparatus.

10. The image forming system according to claim 9, wherein the plurality of the external apparatuses notify the first control unit of the completion upon completion of registration of identification information in response to the registration command.

11. An image forming apparatus that communicates with an external apparatus via a communication unit, the image forming apparatus comprising:

a transmission unit configured to communicate with the external apparatus by using the communication unit and transmit a registration command for setting identification information; and a reception unit configured to receive a status from the external apparatus, wherein the transmission unit transmits, in a state where the identification information is not set n the external apparatus, a confirmation command for confirming a state of the external apparatus to the external apparatus before the transmission unit transmits the registration command to the external apparatus.

12. The image forming apparatus according to claim 11, wherein the reception unit receives the status in response to the confirmation command from the external apparatus, and wherein the transmission unit transmits the registration command to the external apparatus after receiving the status.

13. The image forming apparatus according to claim 11, wherein the image forming apparatus further comprising:

an image forming unit configured to form an image on a recording material;

a fixing unit configured to perform fixing processing on the recording material with an image formed thereon, by using a heating member and a pressure member; and a control unit configured to change a state of the heating and pressure members in the fixing unit from a separated state to a contact state, in parallel with registration of the identification information based on the registration command in the external apparatus.

* * * * *